US006019888A

United States Patent [19]

Mishra et al.

[11] Patent Number: 6,019,888

[45] Date of Patent: Feb. 1, 2000

[54] METHOD OF REDUCING MOISTURE AND SOLID CONTENT OF BITUMEN EXTRACTED FROM TAR SAND MINERALS

[75] Inventors: Surendra K. Mishra, The Woodlands, Tex.; Gordon S. Bond, Big Bear Lake, Calif.

[73] Assignee: Tetra Technologies, Inc., Houston, Tex.

[21] Appl. No.: 09/017,348

[22] Filed: Feb. 2, 1998

[51] Int. Cl.[7] ..... C10G 1/04

[52] U.S. Cl. ..... 208/341; 208/390

[58] Field of Search ..... 208/390, 391

[56] References Cited

U.S. PATENT DOCUMENTS

| | | | |
|---|---|---|---|
| 4,089,803 | 5/1978 | Bessler | 252/344 |
| 4,131,535 | 12/1978 | Porteous | 208/11 LE |
| 4,172,025 | 10/1979 | Porteous et al. | 208/11 LE |
| 4,209,422 | 6/1980 | Zimmerman et al. | 252/344 |
| 4,233,174 | 11/1980 | Sheridan | 252/170 |
| 4,277,352 | 7/1981 | Allison et al. | 252/8.55 D |
| 4,459,200 | 7/1984 | Dente et al. | 208/11 LE |
| 4,491,512 | 1/1985 | Euker | 208/11 LE |
| 4,517,102 | 5/1985 | Salathiel | 252/8.55 R |
| 4,551,239 | 11/1985 | Merchant et al. | 208/188 |
| 4,737,265 | 4/1988 | Merchant et al. | 208/188 |
| 5,236,039 | 8/1993 | Edelstein et al. | 166/248 |
| 5,256,305 | 10/1993 | Hart | 210/708 |
| 5,611,869 | 3/1997 | Hart | 134/22.19 |
| 5,626,743 | 5/1997 | Humphreys | 208/391 |
| 5,679,740 | 10/1997 | Heitner | 524/801 |

*Primary Examiner*—Helane Myers
*Attorney, Agent, or Firm*—Baker & Botts, L.L.P.

[57] ABSTRACT

Tar sand is upgraded to produce a hydrocarbon having a low concentration of water and solids by contacting a bitumen/diluent mix with an alkoxyalkylphenol alkoxylate surfactant prior to separation of a recoverable hydrocarbon phase. The separation of the bitumen/diluent mix into a recoverable hydrocarbon phase and a water/solid phase results in a recoverable hydrocarbon phase that meets the concentration of water and solids desired by tar sand processors. A further refinement of the method involves contacting the bitumen/diluent mix with an anionic and cationic flocculant following the surfactant for further improvement in separation.

17 Claims, 1 Drawing Sheet

METHOD OF REDUCING MOISTURE AND SOLID CONTENT OF BITUMEN EXTRACTED FROM TAR SAND MINERALS

TECHNICAL FIELD OF THE INVENTION

The present invention relates in general to the separation of bitumen from tar sand and more specifically to a process for reducing the moisture and solid content from the bitumen extracted from tar sand.

BACKGROUND OF THE INVENTION

Large volumes of oil exist today in Canada and the United States trapped in deposits of sand or partially formed sandstone known as tar sand or oil sand, hereinafter referred to generically as tar sand. The tar sand is composed of sand, a heavy grade of hydrocarbon called bitumen, mineral rich clays, and water. Bitumen is a mixture of hydrocarbons that can be upgraded and refined by conventional hydrocarbon refining techniques into various consumer products such as gasoline, jet fuel, motor oil, asphalt and light gases such as ethane which can be converted to ethylene and ultimately polyethylene by conventional techniques. Separation of bitumen from the tar sand deposit traditionally has been difficult, costly and often not commercially viable. However, as conventional sources of oil are depleted, and the separation methods improve, tar sand deposits have been increasingly exploited. Nevertheless, separation remains difficult and costly, and methods of improving or easing the separation are needed.

One of the most common separation processes for removing the bitumen from the tar sand is the hot water extraction method. In this process, the tar sand is first removed from the ground using traditional mining techniques, normally strip mining. The mined tar sand is loaded into large vessels known as tumblers where it is combined with heated water or steam and often a caustic solution. The resulting tar sand water mixture is agitated to break apart any large chunks of the mined material and thereby form a relatively uniform slurry of water and tar sand. The physical action of mixing tar sand with the steam results in the separation of the tar sand mixture into two fractions. The first fraction, termed bitumen froth, rises to the top of the slurry mixture and is comprised mostly of bitumen, but also contains smaller amounts of water and solids. The second fraction, a water and solid fraction, settles to the bottom of the slurry and is a mixture of water, and solids. The type of solids found in tar sand may vary depending on the source of the tar sand, but often the solids comprise sand, clay, and other minerals that are mined along with the tar sand. Typically, the water and solid fraction is pumped to tailings ponds for later remediation. The bitumen froth, the fraction most heavily concentrated in bitumen of either of the fractions, is processed to remove more of the solids and water, before the bitumen is sent to be further refined.

The processing of the bitumen froth usually begins with the addition of a hydrocarbon diluent to the bitumen froth. The hydrocarbon diluent is added as a solvent to encourage settling of the water and solids. The resulting bitumen/diluent mix frequently contains greater than 10% water and 0.5% solids. The water in the bitumen/diluent mix contains salts, which can corrode processing vessels and equipment in later bitumen refining steps. To minimize corrosion and other problems, processors desire a reduced water and solid content.

Unfortunately, the water and solids in the bitumen/diluent mix form tiny droplets resulting in an emulsion. An emulsion is a system where tiny droplets of one liquid remain suspended in another liquid. In this emulsion, water droplets surround particles of clay, both of which are then suspended in the oil, and defy most conventional attempts to separate the droplets of water and clay from the bitumen and diluent. Gravity separators such as centrifuges are often used to encourage the separation of emulsions into a recoverable hydrocarbon fraction and a water/solid fraction. However, this step is expensive and often water and solids are still not separated from the bitumen/diluent mix to the extent desired. As a result of the retention of water at a higher than desired concentration, salts and clay contaminants in the recoverable hydrocarbon fraction cause processing problems and equipment damage in later refining steps that process the recoverable hydrocarbon fraction.

SUMMARY OF THE INVENTION

Accordingly, there is a need for a method to upgrade tar sand to produce a hydrocarbon having a low concentration of water and solids. We have found that contacting tar sand bitumen with an alkoxyalkylphenol alkoxylate surfactant results in a recoverable hydrocarbon phase that meets the low concentration of water and solids desired by tar sand processors. A further refinement of the method involves contacting the bitumen/diluent mix with an alkoxyalkylphenol alkoxylate, and optionally contacting with an anionic and cationic flocculant following the surfactant resulting in further improvement in separation. The present invention accomplishes this separation by breaking the emulsion, termed de-emulsification, in the bitumen/diluent mix. Depending on the nature of the emulsion, water in oil or oil in water, the separation efficiency of the oil and water/solid phases may be improved further by incorporating other surfactants in addition to the alkoxyalkylphenol alkoxylate surfactant, selected from the group of anionic surfactants such as alkyl, aryl or alkyl aryl sulfonates or sulfates, and cationic surfactants such as amines. The surfactant or surfactants are added to the bitumen/diluent mix prior to the addition of the flocculants.

Most broadly, this invention comprises the use of an alkoxylalkyl phenol alkoxylate surfactant to break the emulsion of water and solids in a hydrocarbon phase derived from tar sands. Additionally, a cationic flocculant may be used to improved separation. Another embodiment of this invention is:

(a) contacting the bitumen with an alkoxyalkylphenol alkoxylate surfactant, followed by contacting the bitumen with an anionic flocculant, followed by contacting the bitumen with a cationic flocculant; and (b) separating the bitumen into a recoverable hydrocarbon phase and a water phase.

Another embodiment of the invention comprises the following steps:

(a) contacting the bitumen with an alkoxyalkylphenol alkoxylate surfactant and a cationic or anionic surfactant, followed by contacting the bitumen with an anionic flocculant, followed by contacting the bitumen with a cationic flocculant; and (b) separating the bitumen into a recoverable hydrocarbon phase and a water phase.

A further embodiment of the present invention comprises the following steps:

(a) contacting tar sand with water, agitating the mixture, and then allowing it to form a water and solid fraction and bitumen froth fraction;

(b) separating the water and solid fraction from the bitumen froth fraction;

(c) adding a hydrocarbon diluent to the bitumen froth fraction, resulting in a bitumen/diluent mix;

(d) contacting the bitumen/diluent mix with an alkoxyalkylphenol alkoxylate surfactant, followed by contacting the bitumen/diluent mix with an anionic flocculant, followed by contacting the bitumen/diluent mix with a cationic flocculant; and (e) separating the bitumen/diluent mix into a recoverable hydrocarbon phase and a water/solid phase.

One advantage of the present invention is that it results in a recoverable hydrocarbon phase that meets the low target specifications for the water and solid concentration desired by tar sand processors. This invention can be used to reduce the water content of the recovered hydrocarbon phase to less than 0.7 wt % preferably less than 0.6 wt %, and optimally less than 0.3 wt %. This invention can be used to reduce the solids content of the recovered hydrocarbon phase to less than 0.5 wt %, preferably less than 0.3 wt % and optimally less than 0.1 wt %. Another advantage of the present invention is that it reduces investment and equipment for mechanical separation of the bitumen/diluent mix into a recoverable hydrocarbon phase and a water/solid phase.

DESCRIPTION OF THE DRAWINGS

For a more complete understanding of the present invention, reference is now made to the following description taken in conjunction with the accompanying drawings in which like reference numbers indicate like features, wherein.

DETAILED DESCRIPTION OF THE INVENTION

Figure 1:
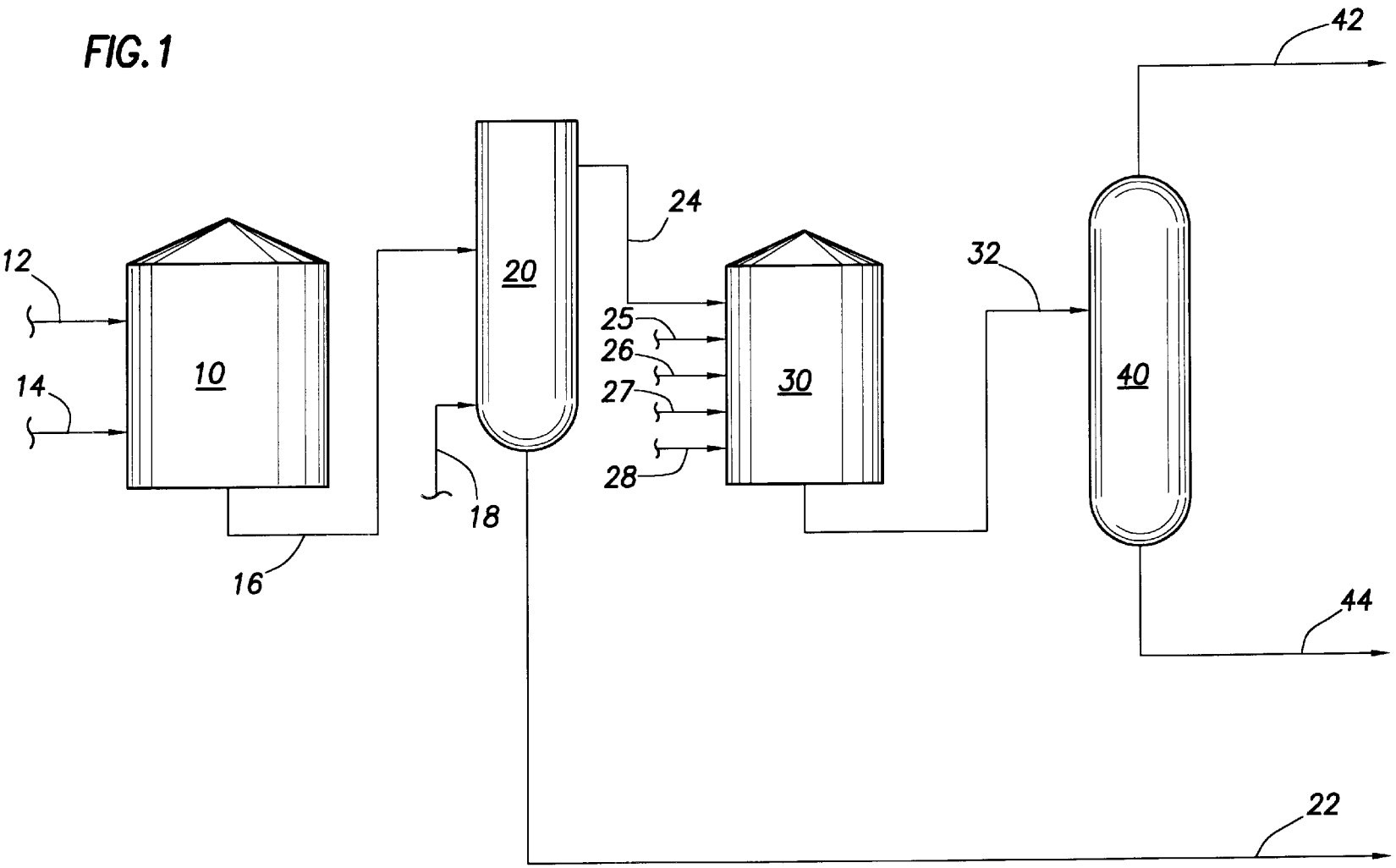
FIG. 1 is a block diagram of one method of reducing moisture and solid content of bitumen extracted from tar sand minerals according to the present invention.

As shown in FIG. 1, tar sand is introduced to mixer vessel 10 through conduit 12. Water is added to mixer vessel 10 through conduit 14. Water and tar sand could also be combined and introduced to mixer vessel 10 together through the same conduit. Alternatively, the water introduced through conduit 14 may be replaced with a caustic or sodium carbonate solution and may be added to mixer vessel 10 through another conduit (not shown). Alternatively, the caustic or sodium carbonate solution may be mixed with the tar sand or water in conduit 12 through the use of an in-line mixer (a device designed to introduce additional turbulence to a fluid flowing through a pipeline in order to mix two or more components, such as through the use of a series of baffles) prior to introduction to mixing vessel 10. The caustic or sodium carbonate solution is added to encourage separation of the bitumen from the solid fraction. Other dispersing agents may also be used. Other chemicals and/or mixing aids may also be added to improve the mixing process in mixer vessel 10. The water and tar sand in mixer vessel 10 are agitated to reduce the size of any large chunks of tar sand detrimental to further downstream processing steps, this process continuing until the tar sand water mixture is substantially uniform. Mixer vessel 10 may be a tumbler (normally a rotating horizontal steel vessel), a mixing tank (a cylindrical tank with an internal mixer designed to agitate its contents) or any other vessel designed to accomplish mixing of the tar sand and water, together with agitation. Water is introduced through conduit 14 and the tar sand is introduced through conduit 12 so that the ratio of water to tar sand in mixer vessel 10 is in the range of 85:15 to 30:70 (by weight). The temperature of the water introduced through conduit 12 is usually between 30 and 95° C., more preferably between 65 and 85° C. The mixing normally occurs at atmospheric pressure, but higher or lower pressures may be employed without departing from the scope of this invention. If the system is operated at higher pressure, higher temperatures may be used, and will improve the separation of bitumen from the solid forming fractions.

The introduction of the tar sand and water into mixer vessel 10 results in a tar sand/water mixture. This tar sand/water mixture is withdrawn from mixer vessel 10 through conduit 16 and introduced to flotation vessel 20. Flotation vessel 20 may be one or more flotation tanks designed to allow separation of a bitumen froth fraction from a water and solid fraction, but may also include any commonly used unit processes in mineral processing such as flotation tanks, screens (perforated plates designed to allow passage of a tar sand/water mixture but not large chunks of tar sand), incline plate separators, hydraulic classifiers (large pools designed to slow flow of liquids and allow gravity separation of dense material), hydrocyclone separators (centrifuges that allow removal of more dense material through bottom openings and less dense material from side or top openings), and combinations of these units. Flotation vessel 20 may be any other separation vessel or system, which may include multiple vessels or equipment in series, that will accomplish a separation into at least two fractions, one fraction having much of the bitumen, and the other fraction having much of the water and solids.

Flotation vessel 20 is usually operated at atmospheric pressure and elevated temperature, but higher or lower temperatures and pressures may be used. In a typical separation, a bitumen froth fraction is separated from a water and solid fraction in flotation vessel 20. The formation of a bitumen froth fraction is typically assisted by entrapment of air in the bitumen fraction such as occurs in the mechanical agitation in mixer vessel 10 or by introduction of a forced air stream into mixer vessel 10, either through conduit 14 or through another conduit (not shown). Optionally, air may be introduced to flotation vessel 20 through conduit 18 to assist in making the bitumen froth. In an alternate embodiment, the separation in flotation vessel 20 is accomplished through the use of multiple vessels. In a first vessel or series of vessels of flotation vessel 20, a portion of the bitumen froth is removed through conduit 24. In a second vessel or series of vessels, air is introduced through conduit 18 to assist in making more of the bitumen froth or through another conduit (not shown). A second portion of the bitumen froth is then removed through conduit 24 or through another conduit (not shown).

The bitumen froth fraction rises above the water and solid fraction and is more concentrated in bitumen. The bitumen froth fraction comprises a substantial portion of the bitumen present in the tar sand added through conduit 12, but it may also comprise some amount of water, sand, clay, and any chemicals or processing aids added to mixer vessel 10. Preferably at least 70% and more preferably at least 90% of the bitumen added through conduit 12 ends up in the bitumen froth. Although it is desirable to recover 100% of the bitumen from the tar sand, it is not usually commercially practical to do so. Preferably, at least 20% of the bitumen froth fraction is bitumen, more preferably at least 30%.

The water and solid fraction comprises a substantial amount of the water and solids from the tar sand water mixture. The water and solid fraction may also comprise some amount of bitumen, clay and any chemicals or processing aids added to mixer vessel 10. Preferably, the bitumen content of the water and solid fraction is kept below 10%, more preferably below 5%. The water and solid fraction is withdrawn from flotation vessel 20 through conduit 22. The water and solid fraction may be disposed of either before or after remedial processing, but preferably it is processed to recover the water which is recycled and reused in the process. Solids recovered from processing the water and solid fraction may be disposed.

The bitumen froth fraction is withdrawn from flotation vessel 20 through conduit 24, and introduced to addition tank 30. Addition tank 30 may consist of one or more tanks in parallel or in series that preferably contain equipment such as motor driven impellers or circulating pump loops designed to thoroughly mix the contents of addition tank 30.

A diluent is added to addition tank 30 through conduit 25, resulting in a bitumen/diluent mix. The diluent encourages separation of the water contained in the bitumen froth from the bitumen and diluent. The diluent is preferably a hydrocarbon, examples including mixed refinery products such as naphtha, gasoline, diesel fuel, kerosene, and heating oil, or more refined products such as hexane, heptane, octane, benzene, toluene or xylene. Preferably the diluent is naphtha. The ratio of diluent to the bitumen froth fraction is usually between 5:1 and 0.1:1, more preferably between 1:1 and 0.6:1, and most preferably between 1:1 and 1:3 (vol:vol). The value of the diluent to bitumen froth ratio depends upon the nature of the bitumen froth and the bitumen content of the bitumen froth fraction. Preferably, the temperature of the diluent added through conduit 25 to addition vessel 30 is between 0° C. and 300° C., more preferably between 50° C. and 150° C. and most preferably between 80° C. and 120° C.

An alkoxyalkylphenol alkoxylate surfactant is added to addition vessel 30 through conduit 26. The surfactant contacts the bitumen/diluent mix within addition vessel 30. Alternatively, the alkoxyalkylphenol alkoxylate surfactant may be added to the diluent using an in-line mixer within conduit 25. Preferably the surfactant is an ethoxylated nonyl phenol and more preferably an ethoxylated nonyl phenol with 4 to 13 ethoxyl groups. Examples of ethoxylated nonyl phenols with 4 to 13 ethoxyl group include Sulfonic NP9 and Sulfonic NP4 manufactured by Huntsman Corporation, and Tergitol NP9 and Tergitol NP4 manufactured by Union Carbide. The surfactant is added through conduit 26 at a ratio of between 1:10 to 1:10,000 kilogram of bitumen/diluent mix to milligram of surfactant, more preferably 1:100 to 1:2,000 (kg:mg) and most preferably between 1:500 to 1:2,000 (kg:mg). The inventors have found a ratio of 1:2,000 kilogram of bitumen/diluent mix to milligram of surfactant to be optimum under many circumstances, but this ratio may vary depending on the characteristics of the bitumen froth. The surfactant is usually added at ambient temperature and pressure, but higher or lower temperatures and pressures may be employed.

Depending on the nature of the bitumen froth, the separation may be improved by contacting the bitumen/diluent mix with an anionic or cationic surfactant. The anionic or cationic surfactant may be added through conduit 24 to addition vessel 30. Alternatively, the cationic or anionic surfactant may be mixed with the alkoxyalkylphenol alkoxylate surfactant and then added conduit 26 to addition vessel 30. Further alternatively, the anionic or cationic surfactant may be added to the diluent using an in-line mixer within conduit 25. The anionic surfactant is preferably an alkyl, aryl, or alkyl aryl sulfonate or sulfate. Specific examples include Witconate 605A manufactured by Witco Corporation. The cationic surfactant is preferably an amine, further preferably a cocamide, tallowamine, or fatty alkyamide. Specific examples include Witcamide 6445 manufactured by Witco Corporation.

Further separation of the bitumen/diluent mix into a recoverable hydrocarbon phase and a water/solid phase can be effected without addition of chemicals other than the surfactant. In that case, the bitumen/diluent mix combined with the surfactant is mixed in addition tank 30, withdrawn through conduit 32 and processed in separation apparatus 40 as described below.

The separation may be improved, however, by the use of one or more flocculants. For instance, an anionic flocculant can be added to addition vessel 30 through conduit 27 and contacted with the bitumen/diluent mix within addition vessel 30. The anionic flocculant is added at a ratio of between 1:1 and 1:500, preferably 1:10 to 1:150, most preferably 1:10 to 1:100 kilogram of bitumen/diluent mix to milligram of flocculant (kg:mg).

A cationic flocculant may then be added through conduit 28. The cationic flocculant is added at a ratio of between 1:1 to 1:5,000 kilogram of bitumen/diluent mix to milligram of flocculant, preferably between 1:40 and 1:1,000 and most preferably 1:50 to 1:500 (kg:mg). The anionic and cationic flocculants may be any polymer flocculants, but are preferably selected from the group of polyacrylamides or polyamides. An example of a commercially available anionic flocculant is TETRAFloc 2503. Examples of commercially available cationic flocculants are TETRAFloc 2060 and TETRAFloc 2080. TETRAFloc flocculants are supplied by Tetra Technologies, Inc. The contacting of the bitumen/diluent mix with the surfactant, the anionic flocculant and the cationic flocculant is best accomplished at between 40 and 95° C., more preferably between 50 and 95° C. Ambient pressure is normally employed, but higher or lower pressures will also work.

It is not necessary to utilize both anionic and cationic flocculants to improve the separation achieved. An anionic flocculant can be used or a cationic flocculant can be used, although if only one type of flocculant is used, it is normally advantageous to use the cationic flocculant. If two or more flocculants are used, they may be employed in any order, i.e. anionic followed by cationic or cationic followed by anionic. Preferably, an anionic flocculant is used first followed by a cationic flocculant. If both an anionic and cationic flocculants are used, the flocculant added first is to be well mixed with the bitumen/diluent mix prior to the addition of the second flocculant. Preferably, the second flocculant added to the bitumen/diluent mix should be added to a separate tank of addition tank 30, or with an in-line mixer after the addition of the first added flocculant.

After contacting the bitumen/diluent mix with the surfactant, the anionic flocculant and the cationic flocculant, the bitumen/diluent mix is withdrawn from addition vessel 30 and introduced to separation apparatus 40 through conduit 32. Separation apparatus 40 is composed of one or more items of equipment well known in the art selected from the group of inclined plate settlers, scroll centrifuges, disc centrifuges or other equipment designed to separate the bitumen/diluent mix into a recoverable hydrocarbon phase and a water/solid phase. Separation apparatus 40 separates the bitumen/diluent mix into a recoverable hydrocarbon phase and a water/solid phase. The recoverable hydrocarbon phase is withdrawn from separation apparatus 40 through conduit 42, and the water/solid phase is withdrawn from separation apparatus 40 through conduit 44.

The amounts of water added to the tar sand, diluent added to the bitumen froth, and surfactant and flocculant added to the bitumen/diluent mix should be combined in effective amounts to accomplish the results desired. These amounts will vary depending on individual process conditions and can be determined by one of ordinary skill in the art. Also, where temperatures and pressures are indicated, those given are a guide to the most reasonable and best conditions known for those processes, but temperatures and pressures outside of those ranges can be used within the scope of this invention. Fluids may be moved through conduits by gravity or preferably through the use of pumps or other fluid moving devices as are known in the art. All ranges of values expressed as between two values are intended to include the value stated in the range.

The invention is further illustrated by the following examples. While the examples illustrate the invention, they are not intended to limit the scope of the invention.

EXAMPLES

Example 1

Baseline

A bitumen froth fraction was obtained from a tar sand processing facility. The bitumen froth contained approximately 60% bitumen, 20% water and 20% solids. Naphtha was added at a ratio of 1:1 naphtha to bitumen by volume (0.6:1 naphtha to bitumen froth) and then thoroughly mixed. The bitumen/naphtha mix was held without mixing while the temperature of the bitumen/naphtha mix was maintained at 80° C. The mix was allowed to settle at room temperature. Distinct layers of oil, water and solid phases formed. A sample taken from the oil phase ½ inch from the surface was taken after 30 hours from the mixing of the naphtha and bitumen froth and found to contain 10% water by weight.

Example 2

A bitumen froth fraction was obtained from a tar sand processing facility. The bitumen froth contained approximately 60% bitumen, 20% water and 20% solids. Naphtha was added at a ratio of 1:1 naphtha to bitumen by volume (0.6:1 naptha to bitumen froth) and then thoroughly mixed. In a 500 ml beaker, 180 ml of the naphtha bitumen froth was heated to 80° C. The bitumen/naphtha mix was then stirred with an electric stirrer and 270 mg of 9-ethoxylated nonyl phenol was added. The mix was allowed to continue stirring and 5.4 mg of TETRAFloc 2530 was added and stirred for 30 seconds, followed by the addition of 66.5 mg of TETRAFloc 2080, and stirred for an additional 10 seconds. The mixture was then allowed to settle at room temperature. Distinct layers of oil, water and solid phases were formed. A sample was withdrawn after 30 minutes from the oil phase ½ inch from the surface and found to contain 0.5% water by weight. A second sample was withdrawn after 2 hours under the same conditions and found to contain 0.12% water by weight.

Example 3

The example was performed on a continuous pilot plant unit that was not at steady state and was run on a batch basis. The following steps were taken beginning at hour zero. Example conditions were maintained until adjusted at the next sample time. The pilot plant was operated at between 70 and 80° C. The pilot plant system was maintained at a pressure slightly more than atmospheric through the use of a nitrogen blanket system. The bitumen used was one that had undergone about 60 days of mixing and aging to form a more stable emulsion. It was pumped to the pilot plant. The diluent used in the example was naphtha. The naphtha was then added to the bitumen froth prior to the heat exchanger and in-line mixing. The diluent to bitumen froth ratio was maintained at 0.6:1 (by volume). The resulting bitumen/naphtha mix was contacted first with the surfactant. The anionic flocculant was then added to the bitumen/naphtha mix through the use of an in-line mixer. The cationic flocculant was then added directly to the bitumen/naphtha mix while in transit by direct injection into the transport piping. A sample was taken of the recovered hydrocarbon phase from the overflow of a gravity settlor and was analyzed for moisture content. Sludge and water were removed through a conduit from the bottom of the gravity settlor. A portion of the sample of the recovered hydrocarbon phase was then centrifuged using a bench scale lab centrifuged sample to further reduce the moisture. A second sample of the recovered hydrocarbon phase was then taken from the centrifuged sample and analyzed for moisture content. Further conditions and the results of this example are contained in Table 1.

TABLE 1

| Sample Time (Hours from start) | Naphtha Temperature (° C.) | Naphtha Flow Rate (kg/min) | Froth Flow Rate (kg/min) | Surfactant (ml/min) | Anionic Flocculant (ml/min) | Cationic Flocculant (ml/min) | % Moisture in recovered oil | % Moisture in recovered oil after centrifuging |
|---|---|---|---|---|---|---|---|---|
| 0* | 70 | 0.9 | 2 | 8.25 | 17 | 120 | 0.954 | 0.61 |
| 0.5 | 70 | 0.9 | 2 | 8.25 | 17 | 120 | 0.8 | 0.43 |
| 2 | 80 | 0.9 | 2 | 8.25 | 24 | 145 | 0.75 | 0.62 |
| 2.5 | 80 | 0.9 | 2 | 8.25 | 24 | 145 | 0.7 | 0.59 |
| 5 | 80 | 0.6 | 1.3 | 8.25 | 24 | 145 | 0.51 | 0.32 |
| 0** | 80 | 0.6 | 1.3 | 8.25 | 13 | 85 | 0.6 | 0.57 |
| 0.5 | 80 | 0.6 | 1.3 | 8.25 | 13 | 85 | 0.64 | 0.5 |
| 2.5 | 80 | 0.6 | 1.3 | 8.25 | 20 | 85 | 0.57 | 0.43 |
| 3 | 80 | 0.6 | 1.3 | 8.25 | 20 | 85 | 0.58 | 0.46 |
| 5 | 80 | 0.6 | 1.3 | 8.25 | 20 | 115 | 0.41 | 0.35 |
| 5.5 | 80 | 0.6 | 1.3 | 8.25 | 20 | 115 | 0.38 | 0.28 |

*Batch 1
**Batch 2

Note that the anionic and cationic flocculants given in Table 1 were at 1% (by weight) concentration. The temperature readings of the pilot plant system are accurate to +/−5° C.

These examples show the improvement obtained using the invention. Other modifications of the invention described above will be obvious to those skilled in the art, and it is intended that the scope of the invention be limited only as set forth in the appended claims.

What is claimed is:

1. A process for extracting bitumen from tar sand comprising bitumen and water wherein the process comprises:

contacting bitumen from the tar sand with a diluent to form a bitumen/diluent mixture and at the same time or subsequently contacting the bitumen/diluent mixture with an alkoxylalkylphenol alkoxylate surfactant to form a bitumen/surfactant mixture, and thereafter, separating the bitumen/surfactant mixture to form a recoverable hydrocarbon portion and a separate water portion.

2. A process in accordance with claim 1 wherein the alkoxylalkylphenol alkoxylate surfactant is an ethoxylated nonyl phenol.

3. A process in accordance with claim 2 wherein the ethoxylated nonyl phenol has 4 to 13 ethoxyl groups.

4. A process in accordance with claim 1 wherein the bitumen/surfactant mixture is contacted with at least one flocculant.

5. A process in accordance with claim 4 wherein the flocculant is selected from the group consisting of polyacrylamide, and polyamine.

6. A process in accordance with claim 4 wherein the flocculant is a cationic flocculant.

7. A process in accordance with claim 4 wherein the bitumen/surfactant mixture is first contacted with an anionic flocculant and then with a cationic flocculant.

8. A process in accordance with claim 4 wherein, the tar sand also comprises solid, and before the bitumen/surfactant mixture is formed, the tar sand is contacted with water to form a tar sand/water mixture and the tar sand/water mixture is separated into a bitumen froth portion and a waste portion comprising water and solid.

9. A process in accordance with claim 8 wherein the surfactant is added in a ratio of 1:10 to 1:10,000 kilogram of bitumen/diluent mixture to milligram of surfactant.

10. A process in accordance with claim 9 wherein the flocculant is added in a ratio of 1:1 to 1:2,000 kilogram of bitumen/diluent mixture to milligram of flocculant.

11. A process in accordance with claim 1 wherein the surfactant is added in a ratio of 1:100 to 1:2,000 kilogram of bitumen/diluent mixture to milligram of surfactant.

12. A process for extracting bitumen from tar sand comprising bitumen, solid and water wherein the process comprises: contacting the tar sand with water to form a tar sand/water mixture; separating the tar sand/water mixture into a bitumen froth portion and a water portion comprising water and solid;

mixing a diluent with an alkoxylalkylphenol alkoxylate surfactant subsequent to the step of forming a tar sand mixture, to form a resulting diluent/surfactant mixture;

contacting the diluent/surfactant mixture with the bitumen froth portion to form the bitumen froth/surfactant mixture; and thereafter, separating the bitumen froth/surfactant mixture to form a recoverable hydrocarbon portion and a separate water portion.

13. A process for extracting bitumen from tar sand which comprises bitumen, solid and water, which process comprises the following steps in sequence:

(a) contacting the tar sand with water, resulting in a tar sand/water mixture;

(b) separating the tar sand/water mixture into a waste phase comprising water and solid and a bitumen froth phase comprising bitumen;

(c) adding a diluent to the bitumen froth phase to form a bitumen froth/diluent mixture and at the same time or subsequently contacting the bitumen froth/diluent mixture with an alkoxylalkylphenol alkoxylate surfactant to form a bitumen/surfactant mixture;

(d) contacting the bitumen/surfactant mixture with one or more flocculants; and (e) separating the bitumen/surfactant mixture into a recoverable hydrocarbon phase and a separate water/solid phase.

14. A process in accordance with claim 13 wherein the alkoxyalkylphenol alkoxylate surfactant is an ethoxylated nonyl phenol having 4 to 13 ethoxyl groups, the surfactant is added in a ratio of 1:100 to 1:2,000 kilogram of bitumen froth/diluent mixture to milligram of surfactant.

15. A process in accordance with claim 14 where the step of contacting the bitumen/surfactant mixture with one or more flocculants comprises first contacting the bitumen/surfactant mixture with an anionic flocculant and subsequently contacting the bitumen/surfactant mixture with a cationic flocculant.

16. A process in accordance with claim 15 wherein an additional surfactant is added to the bitumen froth/diluent mixture and the additional surfactant is selected from the group consisting of cationic surfactants and anionic surfactants.

17. A process in accordance with claim 16 wherein the solids content of the recoverable hydrocarbon phase is less than 0.3 wt % and the water content of the recovered hydrocarbon stream is less than 0.6 wt %.

* * * * *